US007556520B2

(12) United States Patent
Minami et al.

(10) Patent No.: US 7,556,520 B2
(45) Date of Patent: Jul. 7, 2009

(54) LIGHT BULB SOCKET FOR HOLDING A BULB

(75) Inventors: Chihiro Minami, Fujieda (JP); Syungo Ikeno, Fujieda (JP); Yoshito Tanaka, Fujieda (JP)

(73) Assignee: Murkami Corporation, Shizuoka (JP)

( * ) Notice: Subject to any disclaimer, the term of this patent is extended or adjusted under 35 U.S.C. 154(b) by 0 days.

(21) Appl. No.: 12/005,242

(22) Filed: Dec. 26, 2007

(65) Prior Publication Data

US 2008/0233767 A1 Sep. 25, 2008

(30) Foreign Application Priority Data

Mar. 23, 2007 (JP) ..... 2007-077942

(51) Int. Cl.
*H01R 4/50* (2006.01)

(52) U.S. Cl. ..... 439/336; 439/587; 439/602; 439/617; 439/699.2

(58) Field of Classification Search ..... 439/336, 439/602, 617, 699.2, 587
See application file for complete search history.

(56) References Cited

U.S. PATENT DOCUMENTS 4,100,448 A * 7/1978 Chipner et al. ..... 313/318.11
4,573,754 A * 3/1986 Hill ..... 439/280
4,758,181 A * 7/1988 Reedy ..... 439/546
5,463,541 A 10/1995 Greene
5,607,218 A 3/1997 Choji

FOREIGN PATENT DOCUMENTS

| | | | |
|---|---|---|---|
| EP | 1 384 942 | A | 1/2004 |
| GB | 568 738 | A | 7/1945 |
| GB | 1 380 083 | A | 4/1971 |
| GB | 1 507 924 | A | 5/1975 |
| JP | 05-72076 | U | 9/1993 |
| JP | 2002-48922 | A | 2/2000 |

OTHER PUBLICATIONS

European Search Report dated Jun. 5, 2008.

* cited by examiner

*Primary Examiner*—Tho D Ta
(74) *Attorney, Agent, or Firm*—James V. Costigan; Hedman & Costigan, P.C.

(57) ABSTRACT

A bulb socket is provided with a rubber socket into which a bulb is mounted and a resin cover which is mounted on the rubber socket by being put over the rubber socket. A projection which protrudes outward is formed on the resin cover. The resin cover is put over the rubber socket, inserted into a housing, rotated to engage the projection with an engaging part in the housing, and thereby mounted on the housing. At this time, the rubber socket comes into close contact with a socket mounting slot and thereby stops the socket mounting slot water-tightly.

18 Claims, 12 Drawing Sheets

LIGHT BULB SOCKET FOR HOLDING A BULB

The disclosure of Japanese Patent Application No. JP2007-77942 filed on Mar. 23, 2007 including the specification, drawing and abstract is incorporated herein by reference in its entirety.

BACKGROUND OF THE INVENTION

1. Field of the Invention

The present invention relates to a bulb socket which is less liable to come off a housing while maintaining waterproofness.

2. Description of the Related Art

Waterproofness is demanded of lamps installed around car bodies of automobiles or on two-wheeled vehicles (motorcycles), and thus bulbs are often mounted in rubber sockets which are then mounted in housings (casings in which the rubber sockets are mounted). Such a bulb socket is described in Japanese Patent Laid-Open No. 2000-48922 (FIG. 1). Also, a bulb socket mounted in a housing using a bayonet structure is described in Japanese Utility Model Laid-Open No. 5-72076 (FIG. 1).

With the bulb socket described in Japanese Patent Laid-Open No. 2000-48922 (FIG. 1), a rubber socket cylindrical in shape is mounted by simply being inserted in a circular opening (socket mounting slot) of the housing, and thus the socket is liable to come off (fall off) the housing. In contrast, the bulb socket described in Japanese Utility Model Laid-Open No. 5-72076 (FIG. 1) is mounted in a housing using a bayonet structure (a structure in which the bulb socket is inserted, rotated, and held firmly in the housing) which can prevent the bulb socket from coming off.

However, the bayonet structure is generally suited for high-rigidity parts made of resin, metal, or the like, but is not suitable for low-rigidity parts such as rubber sockets. Specifically, if the bayonet structure is used with a low-rigidity part, when the part is inserted into another part (such as a housing) and rotated, the part deforms easily (twists due to the rotation) and the bayonet structure does not follow the rotation, making it difficult to assemble the part to the other part in an intended state. Even if the part is assembled, since the bayonet structure deforms easily due to external force, the part tends to come off the other part easily.

BRIEF SUMMARY OF THE INVENTION

The present invention has been made in view of the above circumstances and has an object to provide a bulb socket which is less liable to come off a housing while maintaining waterproofness.

The present invention provides a bulb socket comprising: a rubber socket into which a bulb is mounted; and a resin cover which is mounted on the rubber socket by being put over the rubber socket, wherein a projection which protrudes outward is formed on the resin cover; and the resin cover is put over the rubber socket, inserted into a housing, rotated to engage the projection with an engaging part in the housing, and thereby mounted on the housing with the rubber socket coming into close contact with a socket mounting slot and thereby stopping the socket mounting slot water-tightly.

According to the present invention, since the rubber socket is covered with the resin cover which is more rigid than the rubber socket and the resin cover is mounted on the housing using a bayonet structure in which the projection formed on the resin cover is engaged with the engaging part formed on the housing and waterproofing is achieved by bringing the rubber socket into close contact with a socket mounting slot of the housing and thereby stopping the socket mounting slot water-tightly, it is possible to make the bulb socket less liable to come off the housing while maintaining waterproofness.

The present invention can be configured as follows: a ring-shaped wall which surrounds the socket mounting slot is formed at the rear part of the socket mounting slot of the housing, protruding backward; a ring-shaped groove is formed in a front end face of the rubber socket; and when the resin cover is put over the rubber socket and inserted in the housing, the ring-shaped wall of the housing is pushed into the ring-shaped groove of the rubber socket thereby stopping the socket mounting slot water-tightly. Since the ring-shaped wall which surrounds the socket mounting slot of the housing is pushed into the ring-shaped groove of the rubber socket, it is possible to ensure watertightness.

The present invention can be configured as follows: a notch which opens forward is formed in front part of the resin cover; and when the ring-shaped wall of the housing is pushed into the ring-shaped groove of the rubber socket, the notch is spread out by pressing force of the rubber socket, spreading the front part of the resin cover outward. This facilitates pushing by reducing insertion loads. After the ring-shaped wall is pushed in, the front part of the resin cover presses the rubber socket from around the rubber socket, ensuring water-tightness more than when the rubber socket is used alone. If the front part of the resin cover where the notch is formed is made thinner-walled than the rear part, it is possible to reduce the insertion loads while maintaining rigidity of the rear part and thereby further facilitate pushing.

In the present invention, a projection can be formed in the housing, the projection fitting in the notch of the resin cover from outside when the resin cover is rotated and thereby mounted on the housing. This makes it possible to prevent the resin cover from coming loose spontaneously from the housing.

The present invention can be configured as follows: the housing has an outer wall formed coaxially with the ring-shaped wall; the engaging part of the housing is formed on the outer wall; and the front part of the resin cover is housed in a ring-shaped groove formed between the inner wall and the outer wall of the housing and the projection of the resin cover is engaged with the engaging part formed on the outer wall.

In the present invention, the engaging part of the housing can be constituted of an open slot which extends circumferentially, being located where the open slot is visible from outside the housing. This makes it possible to visually check how the projection of the resin cover is engaged with the engaging part of the housing.

In the present invention, a collar can be formed on the rubber socket to make it difficult for the resin cover and the rubber socket to come apart when the resin cover is put over the rubber socket.

The present invention can be configured as follows: the rubber socket has a bulging part which constitutes front part and a flat part which constitutes rear part, where frontal shape of the bulging part is circular; the bulb is mounted in the rubber socket by being inserted into a bulb slot which opens to a front end face of the bulging part of the rubber socket; the resin cover has a bulging part whose frontal shape is circular and a flat part, corresponding to the bulging part and the flat part of the rubber socket, respectively; inner space of the resin cover which houses the rubber socket has a bulging-part space formed in the bulging part and a flat-part space formed in the flat part; when the resin cover is put over the rubber socket, the bulging part of the rubber socket is housed in the bulging-part space of the resin cover in close contact with the bulging-part space and the flat part of the rubber socket is housed in the flat-part space of the resin cover in close contact with the flat-part space; the projection of the resin cover is formed on the bulging part of the resin cover; the bulging part of the resin cover is coupled with the housing with the projection fitted in the engaging part of the housing; and the flat part of the resin cover provides a grip for use in attaching and detaching the resin cover to/from the housing. This makes it possible to attach and detach the resin cover to/from the housing easily by manipulating the flat part (grip) of the resin cover with fingers.

The present invention can be configured as follows: a recess is formed on a rear face of the projection of the resin cover; a projection which protrudes outward is formed on the front end face of the rubber socket; and when the resin cover is put over the rubber socket, the projection of the rubber socket is housed in the recess of the resin cover, preventing relative rotation of the rubber socket and the resin cover at positions of the bulging parts.

DETAILED DESCRIPTION OF THE PREFERRED EMBODIMENTS

Figure 2:
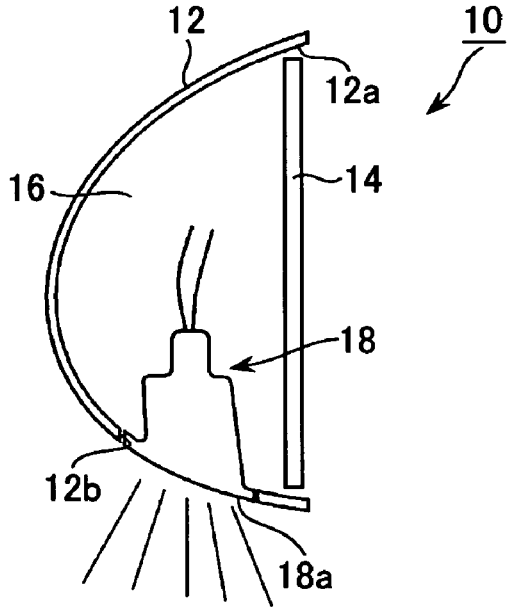
FIG. 2 is a longitudinal sectional view outlining a foot lamp built into a door mirror.

An embodiment of the present invention will be described below. In this embodiment, the present invention is applied to a foot lamp built into a door mirror of an automobile. FIG. 2 outlines a foot lamp built into a door mirror. A door mirror 10 has a mirror plate 14 placed in a front opening 12*a* of a mirror housing 12. In an inner space 16 of the mirror housing 12, a foot lamp 18 is installed with a light emission surface 18*a* turned downward. The light emission surface 18*a* of the foot lamp 18 is closed by a transparent cover and faces downward through an opening 12*b* formed in a bottom of the mirror housing 12. When the foot lamp 18 is turned on, it illuminates the ground below.

Figure 1:
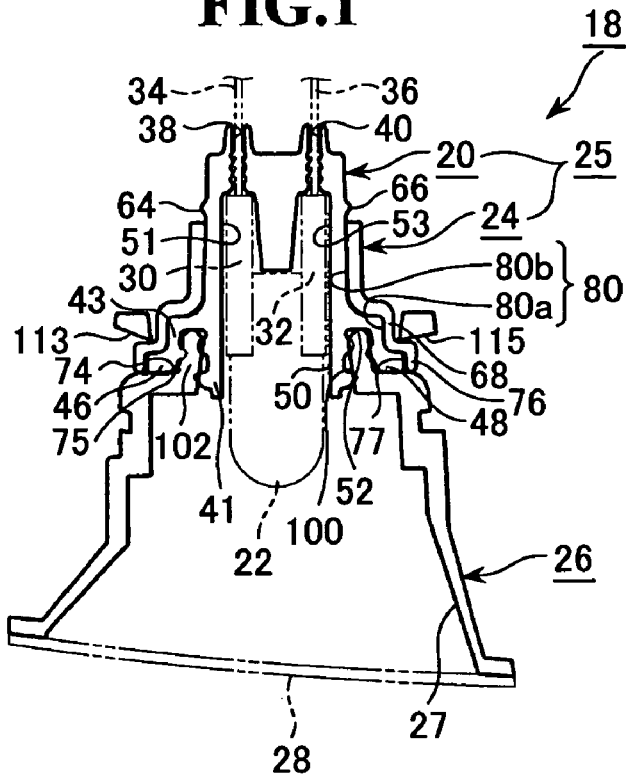
FIG. 1 is a sectional view taken along B-B line in FIG. 3, showing a bulb socket according to an embodiment of the present invention assembled in a housing.
Figure 3:
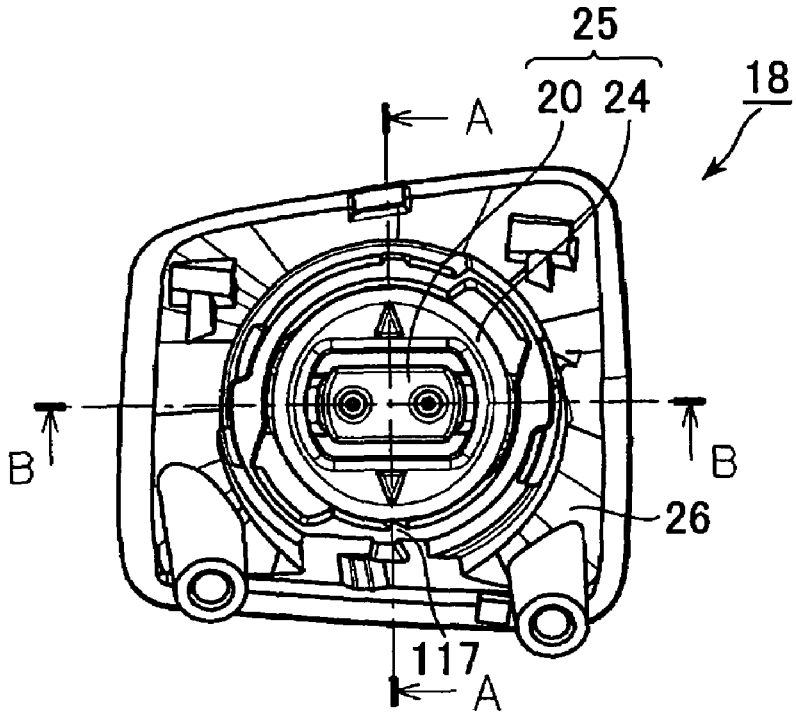
FIG. 3 is a rear view showing the assembled state in FIG.
Figure 4:
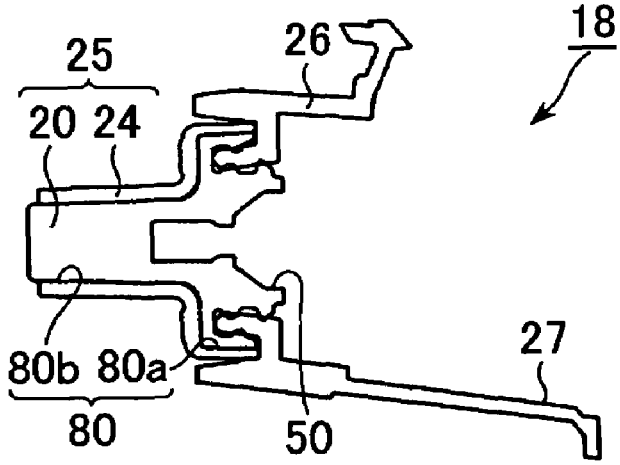
FIG. 4 is a sectional view taken along A-A line in FIG. 3.

A configuration of the foot lamp 18 is shown in FIGS. 1, 3, and 4 (with a bulb, electric wires, and a transparent cover of the light emission surface removed). FIG. 3 is a rear view, FIG. 4 is a sectional view taken along A-A line in FIG. 3, and FIG. 1 is a sectional view taken along B-B line in FIG. 3. The foot lamp 18 is constructed by detachably inserting a bulb 22 into a rubber socket 20, detachably putting a resin cover 24 over the rubber socket 20, and detachably mounting the resin cover 24 on a housing 26 using a bayonet structure. The rubber socket 20 and resin cover 24 make up a bulb socket 25. A front end opening (light emission surface) 27 of the housing 26 is closed by a transparent cover 28. The rubber socket 20 houses socket terminals 30 and 32 which are interconnected with electrode terminals of the bulb 22 (wedge base bulb) when a rear end of the bulb 22 is fitted in the rubber socket 20. The socket terminals 30 and 32 are connected with electric wires 34 and 36, respectively. The electric wires 34 and 36 are drawn out water-tightly through holes 38 and 40 formed in a rear end of the rubber socket 20.

Figure 5:
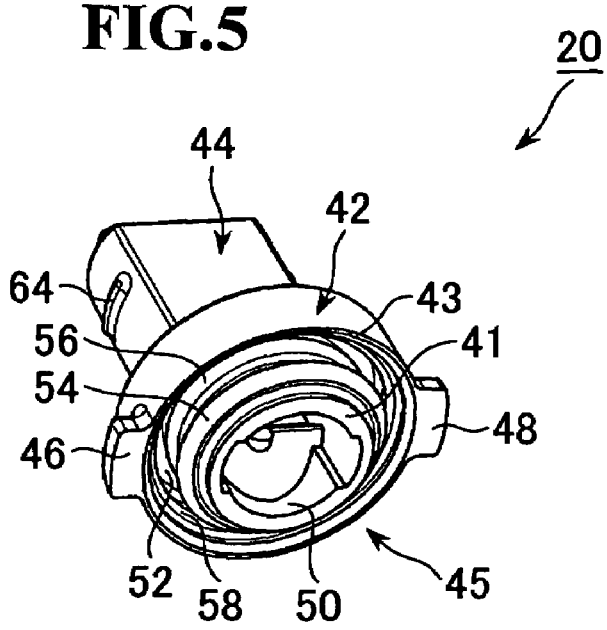
FIG. 5 is a front perspective view of a rubber socket 20.
Figure 6:
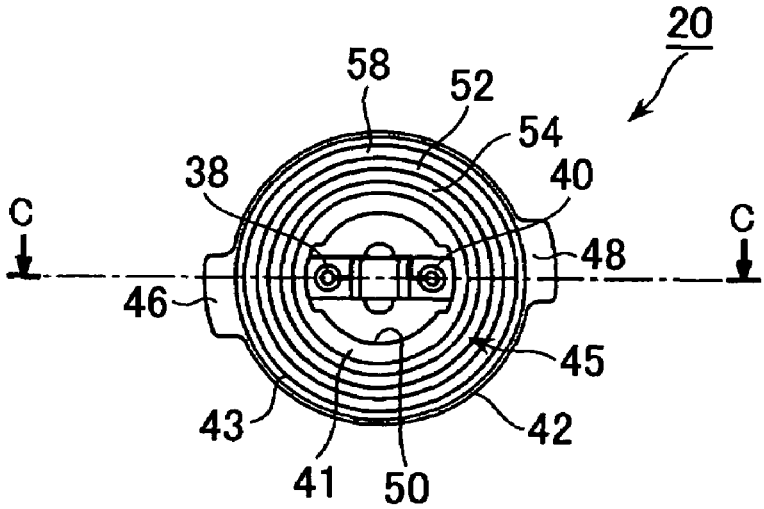
FIG. 6 is a front view of the rubber socket 20.
Figure 7:
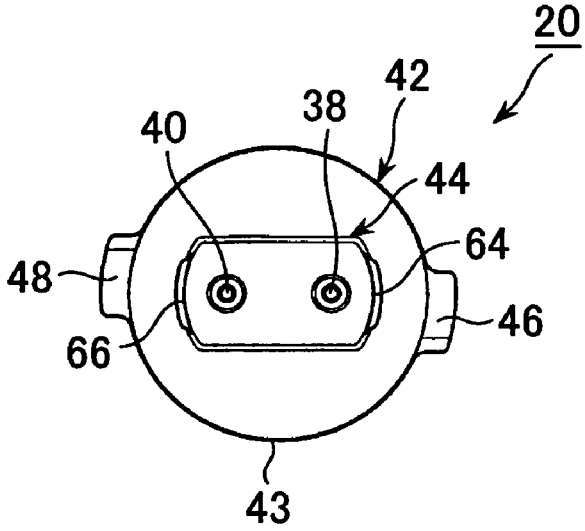
FIG. 7 is a rear view of the rubber socket 20.
Figure 8:
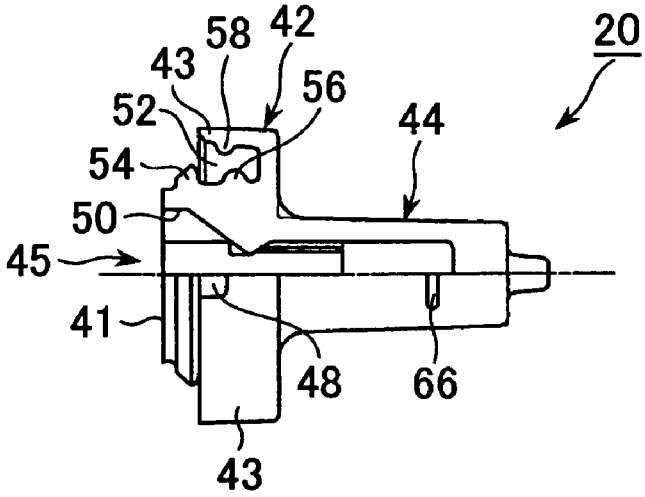
FIG. 8 is a side view of the rubber socket 20 (the upper half is shown in section)
Figure 9:
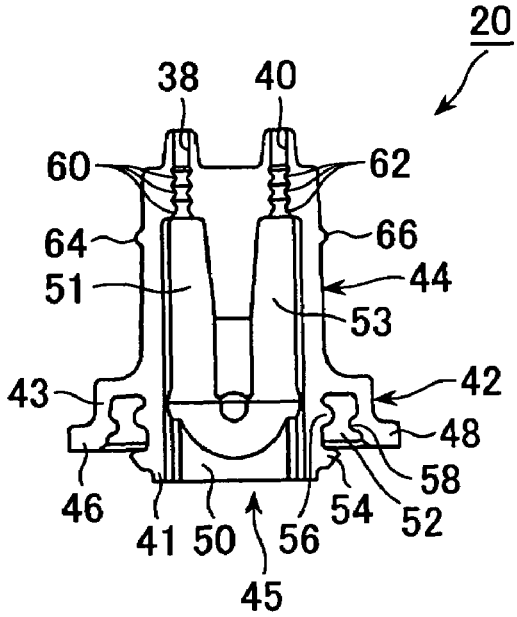
FIG. 9 is a sectional view taken along C-C line in FIG. 6.

Structures of the rubber socket 20, resin cover 24, and housing 26 will be described. First, the rubber socket 20 will be described with reference to FIGS. 5 to 9. FIG. 5 is a front perspective view (viewed from the bulb-slot-side), FIG. 6 is a front view, FIG. 7 is a rear view, FIG. 8 is a side view (the upper half is shown in section), and FIG. 9 is a sectional view taken along C-C line in FIG. 6. The rubber socket 20 is molded in one piece from silicon rubber or the like. The rubber socket 20 has a bulging part 42 which constitutes front part and a flat part 44 which constitutes rear part. Projections 46 and 48 are formed on a front end face 45 of the bulging part 42, protruding in a outward direction at axis-symmetrical positions to each other with respect to the central axis of the bulging part 42. External shape of the bulging part 42 as viewed from the front is circular excluding the projections 46 and 48. A bulb slot 50 is formed in the center of the front end face 45 and a ring-shaped groove 52 is formed coaxially with the bulb slot 50 around the front end face 45. The bulging part 42 is divided radially into an inner ring 41 and outer ring 43 by the ring-shaped groove 52. As shown in FIG. 9, inner part of the bulb slot is divided into cavities 51 and 53. The socket terminals 30 and 32 (FIG. 1) are seated in the cavities 51 and 53 respectively. The bulb 22 (FIG. 1) is inserted in the bulb slot 50, and detachably mounted therein as the rear end (where the electrode terminals are installed) of the bulb 22 is fitted in the socket terminals 30 and 32.

A ring-shaped inner wall 102 of the housing 26 (described later) is pushed in the ring-shaped groove 52 water-tightly (see FIG. 1). Consequently, a socket mounting slot 100 of the housing 26 is sealed water-tightly by the rubber socket 20 mounted on the housing 26 (see FIG. 1). As shown in FIG. 9, two ridges 54 and 56 are formed all around an inner wall surface (outer surface of the inner ring 41) of the ring-shaped groove 52 and a ridge 58 is formed, in a position between the ridges 54 and 56, all around an outer wall surface (inner surface of the outer ring 43) of the ring-shaped groove 52. The ridges 54, 56, and 58 ensure watertightness by coming into close contact with inner and outer surfaces of the ring-shaped inner wall 102 of the housing 26.

As shown in FIG. 9, constrictions 60 and 62 (narrow portions) are formed at appropriate intervals at multiple locations in the respective holes 38 and 40 through which the electric wires 34 and 36 (FIG. 1) are passed. The constrictions 60 and 62 bring outer peripheries of the electric wires 34 and 36 into close contact with inner peripheries of the holes 38 and 40 and thereby close the holes 38 and 40 water-tightly by means of the electric wires 34 and 36. As shown in FIG. 9, collars 64 and 66 (projections) are formed on both sides on an outer periphery of the flat part 44. The collars are restrained by a edge of the resin cover 24 when the resin cover 24 is put over the rubber socket 20, then the collars 64 and 66 prevent the rubber socket 20 from coming off the resin cover 24 easily when the bulb socket 25 is pulled out of the housing 26.

Figure 10:
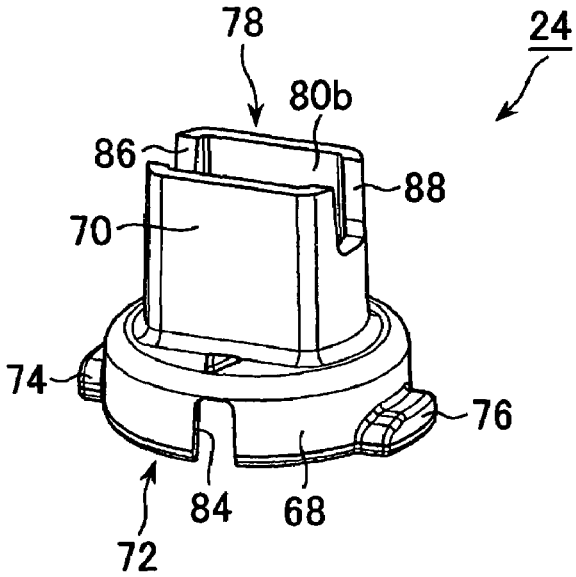
FIG. 10 is a rear perspective view of a resin cover 24.
Figure 11:
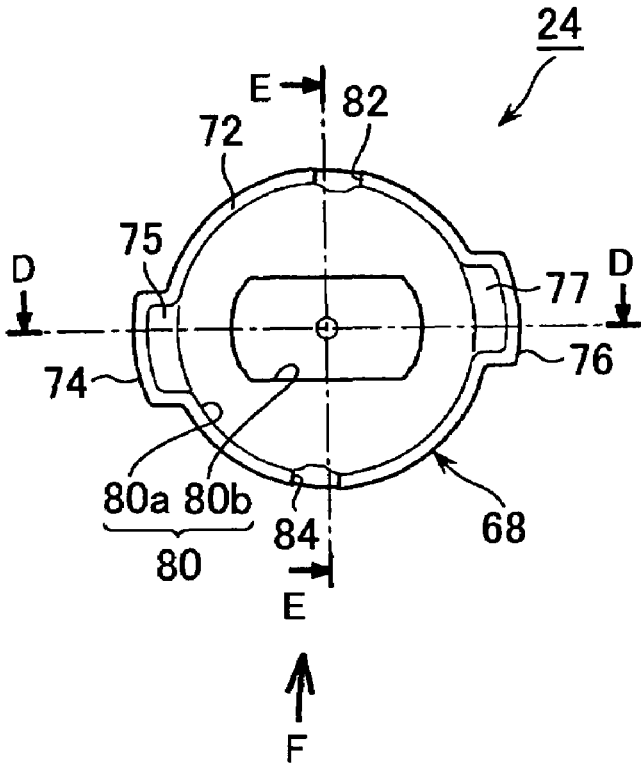
FIG. 11 is a front view of the resin cover 24.
Figure 12:
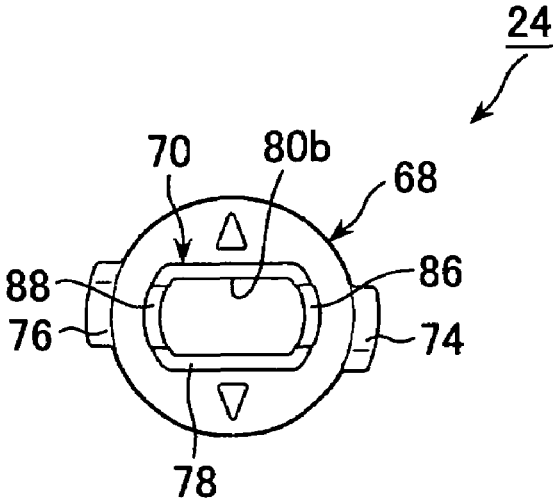
FIG. 12 is a rear view of the resin cover 24.
Figure 13:
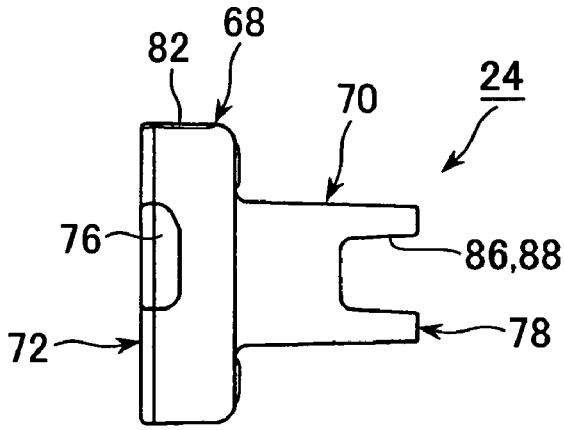
FIG. 13 is a side view of the resin cover 24.
Figure 14:
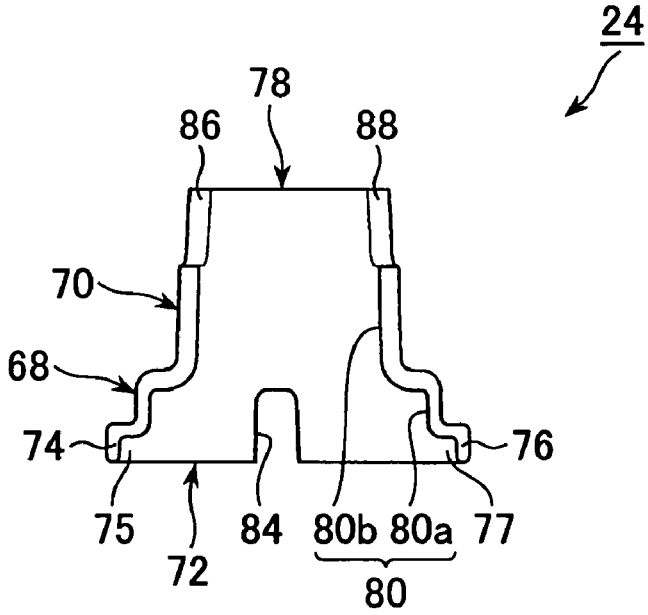
FIG. 14 is a sectional view taken along D-D line in FIG. 11.
Figure 15:
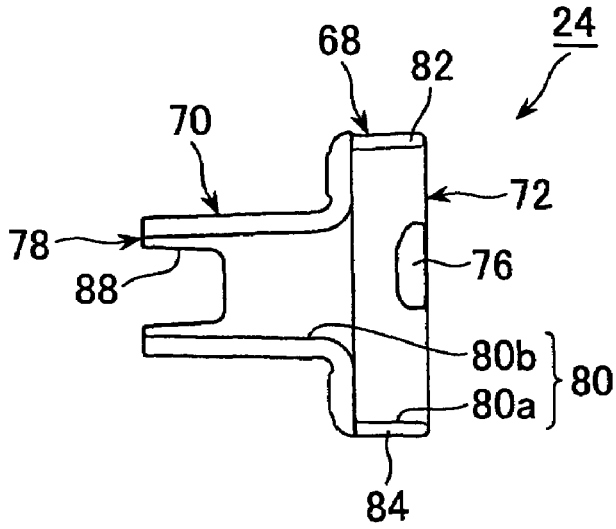
FIG. 15 is a sectional view taken along E-E line in FIG. 11.
Figure 16:
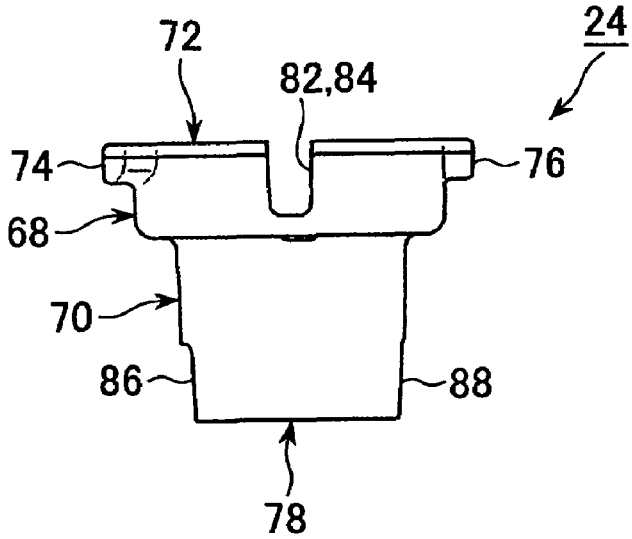
FIG. 16 is a view taken in the direction of arrow F in FIG. 11.

Next, the resin cover 24 will be described with reference to FIGS. 10 to 16. FIG. 10 is a rear perspective view, FIG. 11 is a front view, FIG. 12 is a rear view, FIG. 13 is a side view, FIG. 14 is a sectional view taken along D-D line in FIG. 11, FIG. 15 is a sectional view taken along E-E line in FIG. 11, and FIG. 16 is a view taken in the direction of arrow F in FIG. 11. The resin cover 24 is molded in one piece from plastics such as polypropylene (PP), which is harder than the rubber socket 20. The resin cover 24 has a bulging part 68 which constitutes front part, and a flat part 70 which constitutes rear part. The flat part 70 provides a grip for use in attaching and detaching the resin cover 24 (the rubber socket 20 covered with the resin cover 24), i.e., the bulb socket 25, to/from the housing 26. The bulging part 68 has a uniform wall thickness, and so does the flat part 70. The flat part 70 is thicker-walled than the bulging part 68 (see FIG. 14). Consequently, the flat part 70 have the strength needed for a grip and the bulging part 68 facilitates radial movements by notches 82 and 84 (described later). Projections 74 and 76 are formed on a front end 72 of the bulging part 68, protruding in a outward direction at axis-symmetrical positions to each other with respect to the central axis of the bulging part 68. The projections 74 and 76 constitute a bayonet structure of the bulb socket 25 side. Recesses 75 and 77 are formed on the rear face of the projections 74 and 76. Shape of the bulging part 68 as viewed from the front is circular excluding the projections 74 and 76.

An inner space 80 is formed in the resin cover 24 extending from the front end 72 to the rear end 78. The inner space 80 includes a bulging-part space 80*a* formed in the bulging part 68 and a flat-part space 80*b* formed in the flat part 70, where shape of the bulging-part space 80*a* is circular as viewed from the front excluding the projections 74 and 76 and shape of the flat-part space 80*b* is flat. The inner space 80 coaxially houses the rubber socket 20 through the front end 72. The bulging part 42 and flat part 44 of the rubber socket 20 are held tightly in the bulging-part space 80*a* and flat-part space 80*b* of the resin cover 24, respectively, without play (looseness) (see FIGS. 1 and 4). At this time, the projections 46 and 48 of the rubber socket 20 are housed in recesses 75 and 77 on the inner side of the bulging part 42, respectively. Since the flat parts 44 and 70 are not circular in cross sectional shape, their engagement prevents their relative rotation around the axis. Also, since the projections 46 and 48 are housed in the recesses 75 and 77 respectively, the relative rotation between the bulging parts 42 and 68 around the axis is prevented similarly. At this time the rear end of the rubber socket 20 is exposed from the open rear end 78 of the resin cover 24, with the electric wires 34 and 36 drawn out (see FIG. 1).

On the outer periphery of the bulging part 68, the notches 82 and 84 are formed approximately midway between the projections 74 and 76. When the bulb socket 25 is inserted into the housing 26 (when the inner wall 102 of the housing 26 is pushed into the groove 52 of the rubber socket 20), the notches 82 and 84, being spread out by pressing force of the outer ring 43 generated as the outer ring 43 of the rubber socket 20 is spread out by the inner wall 102 of the housing 26, permits the bulging part 68 to spread outward slightly, and thereby facilitates the insertion. After the insertion, the bulging part 68 presses the outer ring 43 of the bulging part 42 of the rubber socket 20 from around, further ensuring water-tightness. When the bulb socket 25 is rotated after the insertion, a ridge 117 (FIG. 19) formed on the housing 26 fits lightly into the notch 82 or 84 from outside at a position where the rotation is restrained, preventing the bulb socket 25 from coming loose (from turning backward) spontaneously from the housing 26. To facilitate radial movement of the bulging part 68 (spread motion caused by the pressing force of the outer ring 43 of the rubber socket 20), the bulging part 68 is made thinner-walled than the flat part 70 as described above.

Notches 86 and 88 are formed on both sides of the flat part 70, opening to the rear end 78. With the resin cover 24 put over the rubber socket 20, the collars 64 and 66 on both sides of the flat part 44 of the rubber socket 20 are exposed inside the notches 86 and 88. When the bulb socket 25 is pulled out of the housing 26, the collars 64 and 66 are restrained by an edge deep inside the notches 86 and 88, preventing the rubber socket 20 from coming off the resin cover 24.

Figure 17:
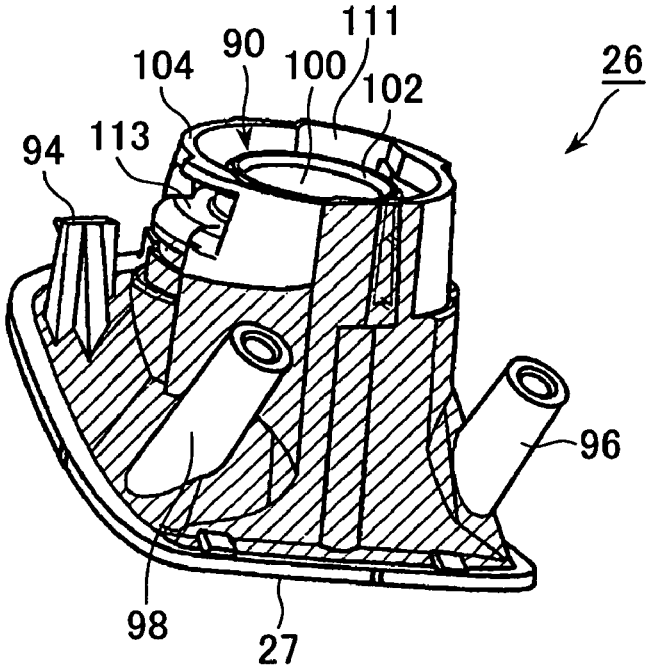
FIG. 17 is a rear perspective view of a housing 26.
Figure 18:
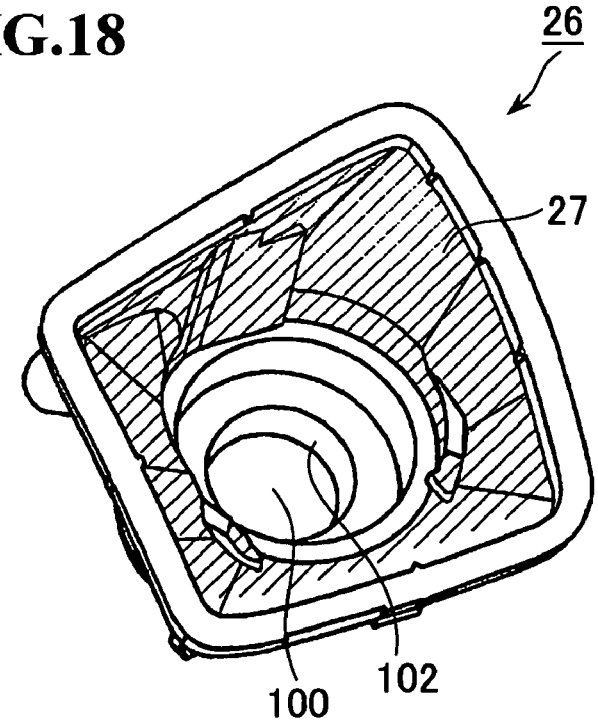
FIG. 18 is a front perspective view of the housing 26 (as viewed from the light emission surface side)
Figure 19:
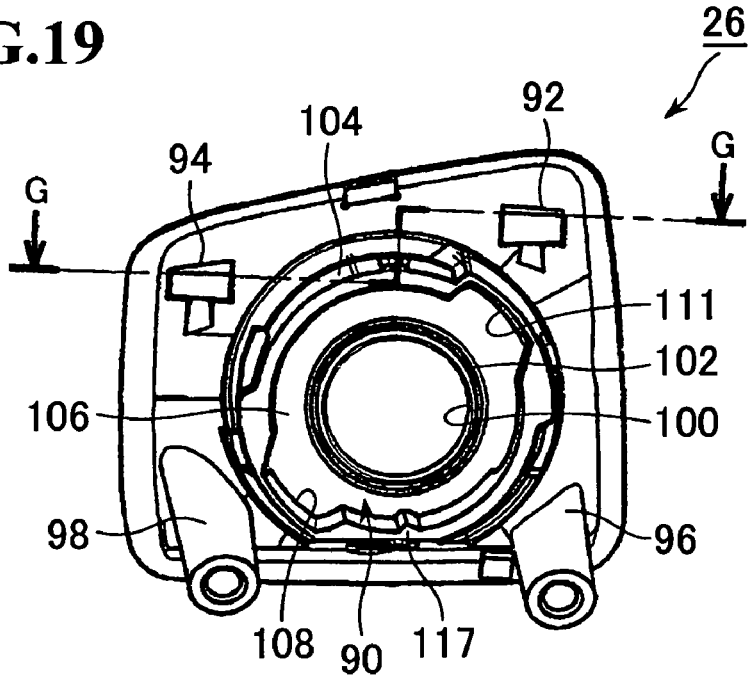
FIG. 19 is a rear view of the housing 26.
Figure 20:
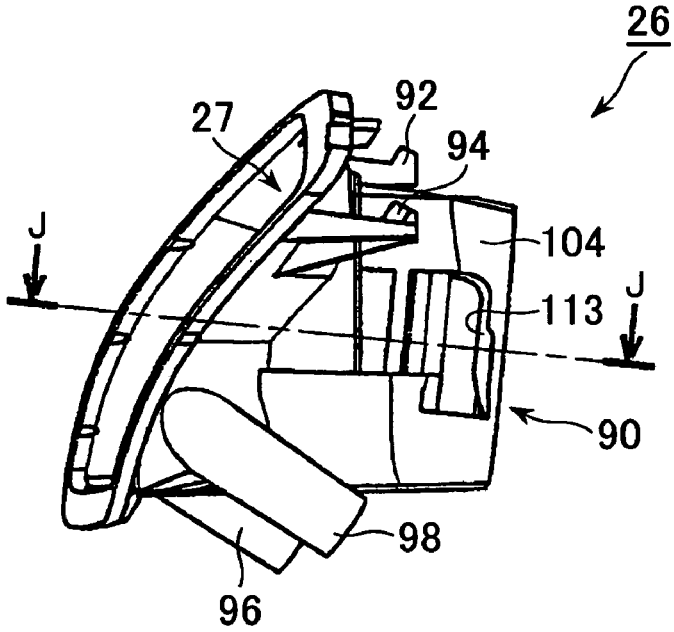
FIG. 20 is a side view of the housing 26.
Figure 21:
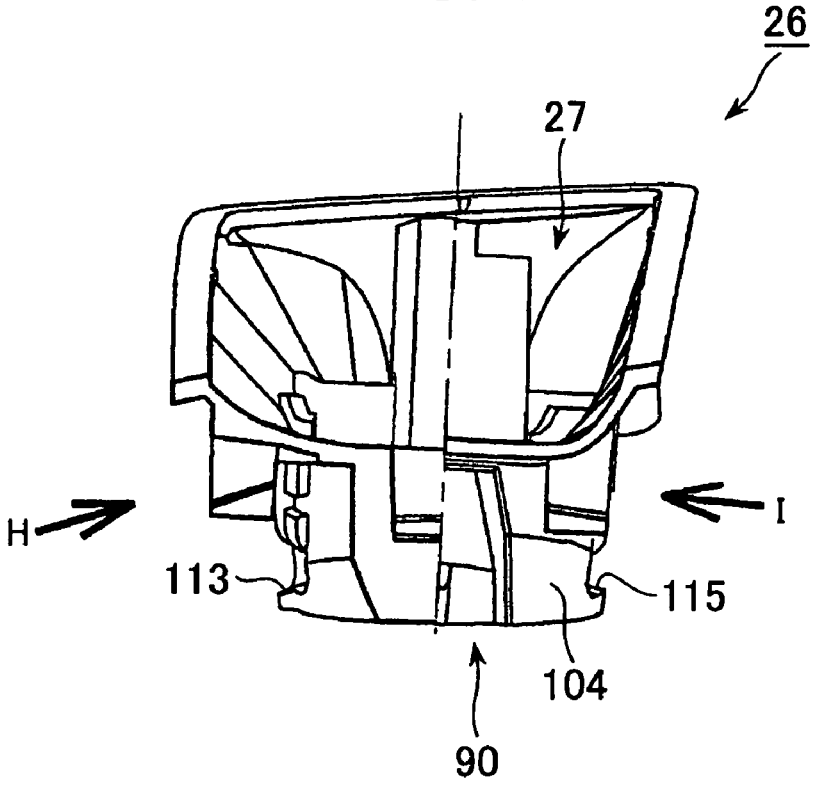
FIG. 21 is a sectional view taken along G-G line in FIG. 19.
Figure 22:
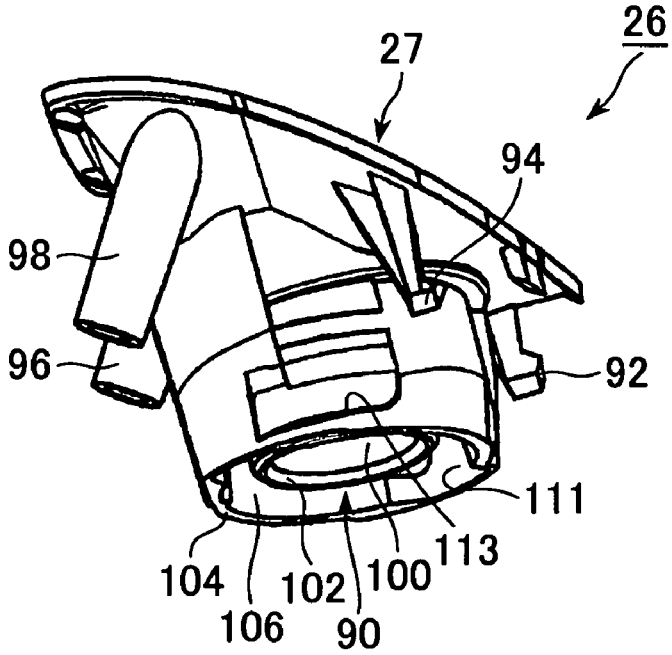
FIG. 22 is a view taken in the direction of arrow H in FIG. 21.
Figure 23:
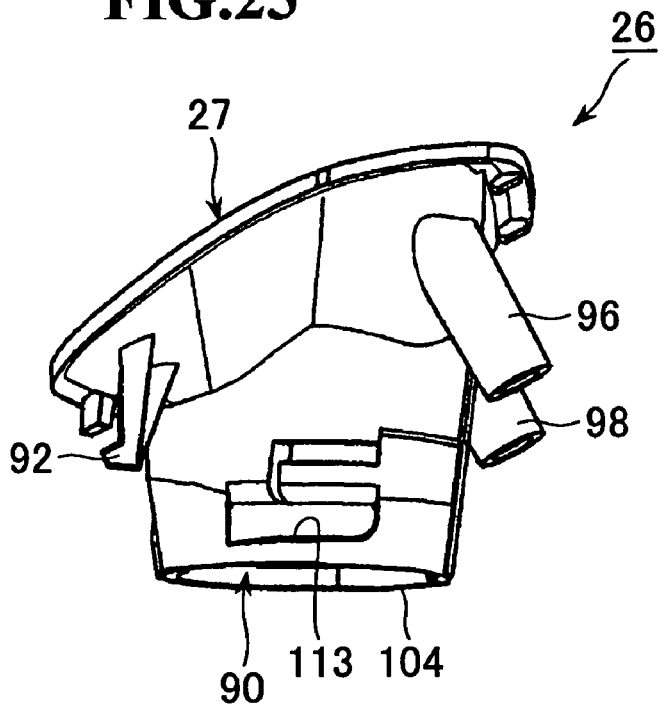
FIG. 23 is a view taken in the direction of arrow I in FIG. 21.
Figure 24:
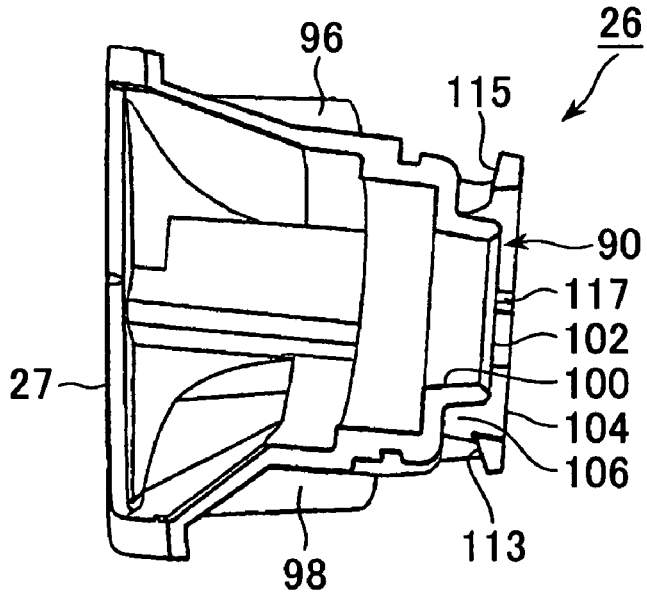
FIG. 24 is a sectional view taken along J-J line in FIG. 20.

Next, the housing 26 will be described with reference to FIGS. 17 to 24. FIG. 17 is a rear perspective view, FIG. 18 is a front perspective view (as viewed from the light emission surface side), FIG. 19 is a rear view, FIG. 20 is a side view, FIG. 21 is a sectional view taken along G-G line in FIG. 19, FIG. 22 is a view taken in the direction of arrow H in FIG. 21, FIG. 23 is a view taken in the direction of arrow I in FIG. 21, and FIG. 24 is a sectional view taken along J-J line in FIG. 20. The housing 26 is molded in one piece from plastics such as a mixture (PC+PBT) of polybutylene terephthalate, which is harder than the rubber socket 20. The housing 26 is bell-shaped as a whole and has a front end opening 27 and rear end opening 90 at opposite axial ends. The front end opening 27 is closed water-tightly by a transparent cover 28 and the bulb socket 25 is mounted on the rear end opening 90 using a bayonet structure. The socket mounting slot 100 in the center of the rear end opening 90 is closed water-tightly by the rubber socket 20 (FIG. 1). Claws 92 and 94 for use to mount the housing 26 on the mirror housing 12 (FIG. 2) and bosses 96 and 98 for screw-fastening are formed on the outer periphery of the housing 26.

A mounting structure of the bulb socket 25 formed in the rear end opening 90 of the housing 26 will be described. The socket mounting slot 100 is formed in the center of the rear end opening 90. The rear part of the socket mounting slot 100 is surrounded by the ring-shaped inner wall 102 which protrudes backward. The inner wall 102 is pushed and housed water-tightly in the groove 52 formed in the front end face 45 of the rubber socket 20. In the rear end opening 90, an outer wall 104 is formed coaxially with the inner wall 102 in such a way as to surround the inner wall 102. A ring-shaped groove 106 is formed between the inner wall 102 and outer wall 104. The outer ring 43 of the bulging part 42 of the rubber socket 20 and bulging part 68 of the resin cover 24 are inserted in the ring-shaped groove 106. Recesses 108 and 111 which accept the projections 74 and 76 of the resin cover 24 are formed in the outer wall 104 at axis-symmetrical positions to each other with respect to the central axis. Open slots 113 and 115 are formed in the outer wall 104, extending circumferentially by continuing from the recesses 108 and 111. The recesses 108 and 111 and open slots 113 and 115 constitute the bayonet structure of the housing 26 side. That is, after the projections 74 and 76 of the bulb socket 25 are inserted into the recesses 108 and 111, when the resin cover 24 (bulb socket 25) is rotated clockwise, the projections 74 and 76 advances into the open slots 113 and 115 to be restrained therein. Consequently, the bulb socket 25 is mounted on the rear end opening 90 of the housing 26. Besides, the ridge 117 is formed on the outer wall 104, which extends in the axial direction. The ridge 117 fits into the notch 82 or 84 formed in the bulging part 68 of the resin cover 24 at a position where the rotation of the bulb socket 25 is restrained.

Now, description will be given of procedures for assembling the rubber socket 20, resin cover 24, and housing 26 configured as described above.

(1) The resin cover 24 is mounted on the rubber socket 20 by positioning them in the rotation direction in such a way that the projections 46 and 48 of the rubber socket 20 will be housed, respectively, in the recesses 75 and 77 formed on the rear face of the projections 74 and 76 on the resin cover 24. The electric wires 34 and 36 of the rubber socket 20 are drawn out from the open rear end 78 of the resin cover 24. The collars 64 and 66 formed on the flanks of the rubber socket 20 are exposed at the deep position inside the notches 86 and 88 of the resin cover 24, preventing the rubber socket 20 from coming off the resin cover 24 easily.

(2) The bulb 22 is mounted in the rubber socket 20 by being inserted in the bulb slot 50 of the rubber socket 20. Alternatively, the bulb 22 may be inserted in the bulb slot 50 of the rubber socket 20 before mounting the resin cover 24 on the rubber socket 20.

(3) Once the bulb socket 25 is assembled by putting the resin cover 24 over the rubber socket 20, the bulb socket 25 is mounted on the rear end opening 90 of the housing 26 by pinching the flat part (grip) 70 between fingers. That is, with the projections 74 and 76 on the resin cover 24 aligned with the recesses 108 and 111 in the housing 26, the front end 72 of the resin cover 24 is inserted into the rear end opening 90 of the housing 26. At this time, the ring-shaped inner wall 102 of the housing 26 is pushed water-tightly in the ring-shaped groove 52 of the rubber socket 20. After the insertion, as the flat part 70 is turned clockwise with fingers, the projections 74 and 76 on the bulb socket 25 enters the open slots 113 and 115, and the bulb socket 25 is mounted on the housing 26 by means of the bayonet structure. When the bulb socket 25 is rotated, the flat part 44 of the rubber socket 20 and flat part 70 of the resin cover 24 are in close contact with each other via non-circular cross-sectional shape, preventing relative rotation of the rubber socket 20 and resin cover 24. Also, since the projections 74 and 76 on the resin cover 24 are inserted in the recesses 108 and 111 of the housing 26, the relative rotation of the rubber socket 20 and resin cover 24 are prevented at their tips as well. Thus, the rubber socket 20 and resin cover 24 rotate as one. Since the rubber socket 20 is rotated by being covered with the resin cover 24 which has rigidity, the bulb socket 25 as a whole becomes more rigid than when the rubber socket 20 is rotated alone. This prevents the rubber socket 20 from bending (twisting) due to rotation, making it easier to perform the assembly operation. When the bulb socket 25 is rotated until the projections 46 and 48 are restrained at the end of the open slots 113 and 115, the ridge 117 of the housing 26 fits into the notch 82 or 84 of the resin cover 24, preventing the bulb socket 25 from turning backward spontaneously. At this time, since engagement of the projections 74 and 76 with the open slots 113 and 115 can be checked visually from outside the housing 26 through the open slots 113 and 115, it is possible to check how the bulb socket 25 is assembled to the housing 26, making it easier to carry out the assembly operation.

After the assembly, since the bayonet structure is made up of the resin cover 24 and housing 26 both of which has rigidity, the bulb socket 25 is less liable to come off the housing 26 even if external force is added. Moreover, the socket mounting slot 100 of the housing 26 is sealed water-tightly by the rubber socket 20, ensuring waterproofness.

To change the bulb 22, the assembly procedures described above are reversed. Specifically, the flat part 70 of the bulb socket 25 is rotated counterclockwise by being pinched with fingers. When the counterclockwise rotation is restrained, the flat part 70 is pulled by still being pinched with the fingers. Consequently, the bulb socket 25 is removed from the housing 26. In so doing, since the collars 64 and 66 of the rubber socket 20 are caught (restrained) by the edge deep inside the notches 86 and 88 of the resin cover 24, the rubber socket 20 is removed from the housing 26 together with the resin cover 24 without coming off the resin cover 24.

Incidentally, if single rubber sockets 20 stacked in a box are kept in stock at a factory or the like for an extended period of time, the rubber sockets 20 placed below may get deformed under the weight of the rubber sockets 20 located above and become unable to return to their original shape, rendering themselves unusable as a product. Thus, the rubber sockets 20 are stored by being covered with the resin covers 24. This will prevent the components from being deformed even if they are stored by being stacked up in a box because the resin cover 24 has high rigidity.

In the embodiment described above, the present invention is applied to a foot lamp built into a door mirror of an automobile. However, in addition to foot lamps, the present invention can also be applied to lamps installed around car bodies of automobiles, lamps for two-wheeled vehicles (motorcycles), and other lamps which need to be waterproof.

What is claimed is:

1. A bulb socket comprising: a rubber socket into which a bulb is mounted; a resin cover which is mounted on the rubber socket by being put over the rubber socket; and a housing, wherein a projection which protrudes outward is formed on the resin cover;

a socket mounting slot is formed on the housing; and the resin cover is put over the rubber socket, on the housing with the rubber socket being inserted into the socket mounting slot, rotated to engage the projection with an engaging part in the housing, and thereby mounted on the housing with the bulb being inserted into the housing through the socket mounting slot and the rubber socket coming into close contact with the socket mounting slot and the bulb thereby stopping the socket mounting slot water-tightly at the housing and at the bulb and to make the inside of the housing waterproof.

2. The bulb socket according to claim 1, wherein the engaging part of the housing is constituted of an open slot which extends circumferentially, being located where the open slot is visible from outside the housing.

3. The bulb socket according to claim 1, wherein a collar is formed on the rubber socket to make it difficult for the resin cover and the rubber socket to come apart when the resin cover is put over the rubber socket.

4. The bulb socket according to claim 1, wherein:

a ring-shaped wall which surrounds the socket mounting slot is formed at the rear part of the socket mounting slot of the housing, protruding backward;

a ring-shaped groove is formed in a front end face of the rubber socket; and when the resin cover is put over the rubber socket and inserted in the housing, the ring-shaped wall of the housing is pushed in the ring-shaped groove of the rubber socket thereby stopping the socket mounting slot water-tightly.

5. The bulb socket according to claim 4, wherein:

the housing has an outer wall formed coaxially with the ring-shaped wall;

the engaging part of the housing is formed on the outer wall; and the front part of the resin cover is housed in a ring-shaped groove formed between the inner wall and the outer wall of the housing and the projection of the resin cover is engaged with the engaging part formed on the outer wall.

6. The bulb socket according to claim 4, wherein:

a notch which opens forward is formed in front part of the resin cover; and when the ring-shaped wall of the housing is pushed into the ring-shaped groove of the rubber socket, the notch is spread out by pressing force of the rubber socket, spreading the front part of the resin cover outward.

7. The bulb socket according to claim 6, wherein the front part of the resin cover where the notch is formed is thinner-walled than rear part.

8. The bulb socket according to claim 7, wherein a projection is formed in the housing, the projection fitting in the notch of the resin cover from outside when the resin cover is rotated and thereby mounted on the housing.

9. The bulb socket according to claim 1, wherein:

the rubber socket has a bulging part which constitutes front part and a flat part which constitutes rear part, where frontal shape of the bulging part is circular;

the bulb is mounted on the rubber socket by being inserted into a bulb slot which opens to a front end face of the bulging part of the rubber socket;

the resin cover has a bulging part whose frontal shape is circular and a flat part, corresponding to the bulging part and the flat part of the rubber socket, respectively;

inner space of the resin cover which houses the rubber socket has a bulging-part space formed in the bulging part and a flat-part space formed in the flat part;

when the resin cover is put over the rubber socket, the bulging part of the rubber socket is housed in the bulging-part space of the resin cover in close contact with the bulging-part space and the flat part of the rubber socket is housed in the flat-part space of the resin cover in close contact with the flat-part space;

the projection of the resin cover is formed on the bulging part of the resin cover;

the bulging part of the resin cover is coupled with the housing with the projection fitted in the engaging part of the housing; and the flat part of the resin cover provides a grip for use in attaching and detaching the resin cover to/from the housing.

10. The bulb socket according to claim 9, wherein:

a recess is formed on a rear face of the projection of the resin cover;

a projection of the rubber socket is housed in the recess of the resin cover, preventing relative rotation of the rubber socket and the resin cover at positions of the bulging parts.

11. A bulb socket comprising: a rubber socket into which a bulb is mounted; and a resin cover which is mounted on the rubber socket by being put over the rubber socket, wherein a projection which protrudes outward is formed on the resin cover; and the resin cover is put over the rubber socket, inserted into a housing, rotated to engage the projection with an engaging part in the housing, and thereby mounted on the housing with the rubber socket coming into close contact with a socket mounting slot wherein a ring-shaped wall, which surrounds the socket mounting slot, is formed at the rear part of the socket mounting slot of the housing, and protrudes backwardly; and having a ring-shaped groove formed in a front end face of the rubber socket so that when the resin cover is put over the rubber socket and inserted in the housing, the ring-shaped wall of the housing is pushed in the ring-shaped groove of the rubber socket thereby stopping the socket mounting slot water-tightly.

12. The bulb socket according to claim 11, wherein:

the housing has an outer wall formed coaxially with the ring-shaped wall;

the engaging part of the housing is formed on the outer wall; and the front part of the resin cover is housed in a ring-shaped groove formed between the inner wall and the outer wall of the housing and the projection of the resin cover is engaged with the engaging part formed on the outer wall.

13. The bulb socket according to claim 11, wherein a collar is formed on the rubber socket to make it difficult for the resin cover and the rubber socket to come apart when the resin cover is put over the rubber socket.

14. The bulb socket according to claim 11, wherein: a notch which opens forward is formed in front part of the resin cover; and when the ring-shaped wall of the housing is pushed into the ring-shaped groove of the rubber socket, the notch is spread out by pressing force of the rubber socket, spreading the front part of the resin cover outward.

15. The bulb socket according to claim 14, wherein the front part of the resin cover where the notch is formed is thinner-walled than rear part.

16. The bulb socket according to claim 15, wherein a projection is formed in the housing, the projection fitting in the notch of the resin cover from outside when the resin cover is rotated and thereby mounted on the housing.

17. The bulb socket according to claim 11, wherein:

the rubber socket has a bulging part which constitutes front part and a flat part which constitutes rear part, where frontal shape of the bulging part is circular;

the bulb is mounted on the rubber socket by being inserted into a bulb slot which opens to a front end face of the bulging part of the rubber socket;

the resin cover has a bulging part whose frontal shape is circular and a flat part, corresponding to the bulging part and the flat part of the rubber socket, respectively;

inner space of the resin cover which houses the rubber socket has a bulging-part space formed in the bulging part and a flat-part space formed in the flat part;

when the resin cover is put over the rubber socket, the bulging part of the rubber socket is housed in the bulging-part space of the resin cover in close contact with the bulging-part space and the flat part of the rubber socket is housed in the flat-part space of the resin cover in close contact with the flat-part space;

the projection of the resin cover is formed on the bulging part of the resin cover;

the bulging part of the resin cover is coupled with the housing with the projection fitted in the engaging part of the housing; and the flat part of the resin cover provides a grip for use in attaching and detaching the resin cover to/from the housing.

18. The bulb socket according to claim 17, wherein:

a recess is formed on a rear face of the projection of the resin cover;

a projection of the rubber socket is housed in the recess of the resin cover, preventing relative rotation of the rubber socket and the resin cover at positions of the bulging parts.

* * * * *